US005584915A

United States Patent [19]

Broughton

[11] Patent Number: 5,584,915

[45] Date of Patent: Dec. 17, 1996

[54] APPARATUS FOR PREVENTING SPARKING IN A HIGH VOLTAGE ELECTRICAL PRECIPITATOR

[75] Inventor: David A. Broughton, Fredonia, Wis.

[73] Assignee: Wisconsin Electric Power Company, Milwaukee, Wis.

[21] Appl. No.: 349,822

[22] Filed: Dec. 6, 1994

[51] Int. Cl.[6] ..... B03C 3/70; B03C 3/76

[52] U.S. Cl. ..... 96/32; 95/76; 96/88

[58] Field of Search ..... 96/88, 32, 36, 96/83, 92; 95/76

[56] References Cited

U.S. PATENT DOCUMENTS

| | | | |
|---|---|---|---|
| 1,806,854 | 5/1931 | Hesson | 96/88 |
| 1,903,640 | 4/1933 | Wintermute | 96/32 |
| 2,595,204 | 4/1952 | Richardson | 96/32 |
| 2,775,640 | 12/1956 | Steeves | 96/88 X |
| 3,109,720 | 11/1963 | Cummings et al. | 95/76 |
| 3,362,134 | 1/1968 | Wiemer | 96/88 X |
| 4,071,688 | 1/1978 | Lynch et al. | 96/88 |
| 4,077,783 | 3/1978 | Honacker | 55/DIG. 38 |
| 4,117,255 | 9/1978 | Kawaike et al. | 96/88 X |
| 4,167,400 | 9/1979 | Onushco | 96/88 |
| 5,006,134 | 4/1991 | Knoll et al. | 96/88 |
| 5,055,117 | 10/1991 | Cai | 96/88 X |

FOREIGN PATENT DOCUMENTS

| | | | |
|---|---|---|---|
| 259799 | 9/1988 | German Dem. Rep. | 96/88 |
| 3702469 | 8/1988 | Germany | 96/88 |
| 469287 | 8/1977 | U.S.S.R. | 96/88 |
| 1286289 | 1/1987 | U.S.S.R. | 96/88 |
| 914299 | 1/1963 | United Kingdom | 96/88 |

*Primary Examiner*—Richard L. Chiesa

*Attorney, Agent, or Firm*—Andrus, Sceales, Starke & Sawall

[57] ABSTRACT

An apparatus is disclosed for improving the performance of a high voltage, rapper-type precipitator having a supply electrode and a rapper rod passing through a grounded precipitator roof and attached to an array of discharge electrodes. Alumina insulation sleeves are installed over the supply electrodes and rapper rods to prevent sparking to the grounded precipitator roof. A shock absorber is provided on the lower end of the insulator to prevent damage to the insulator during precipitator rapping.

19 Claims, 3 Drawing Sheets

FIG. 3
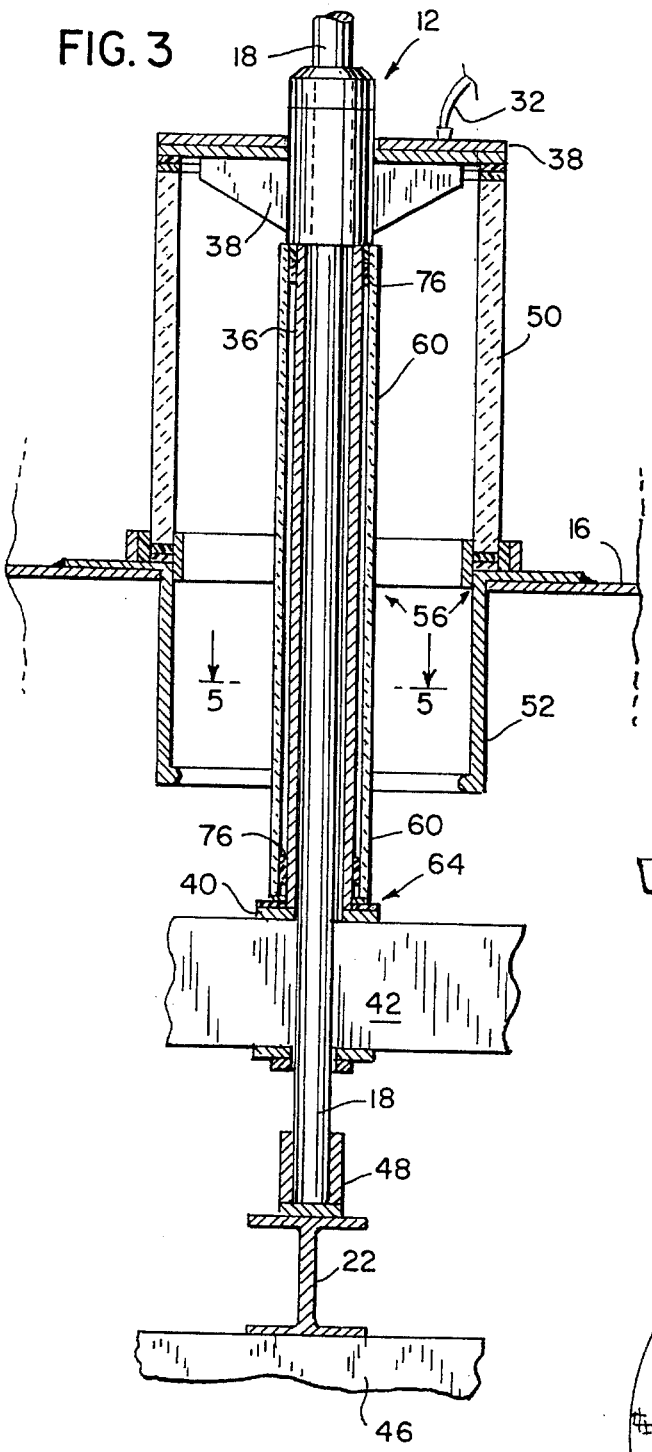
FIG. 4
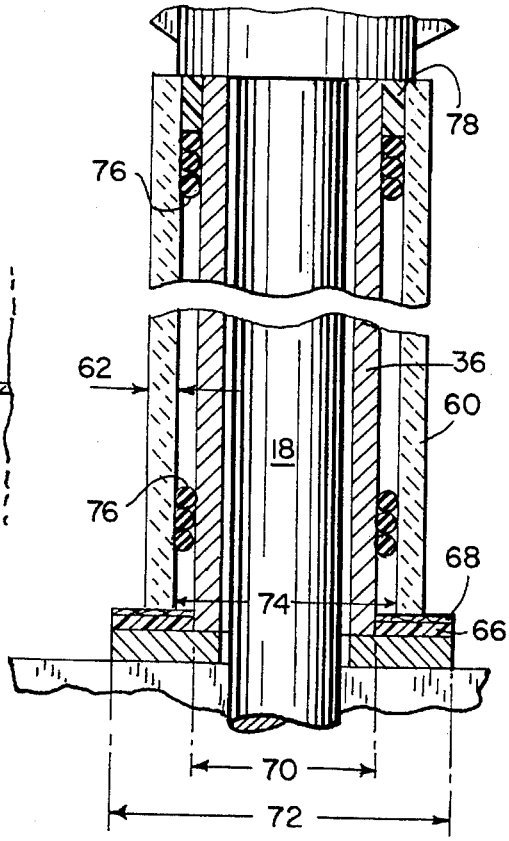
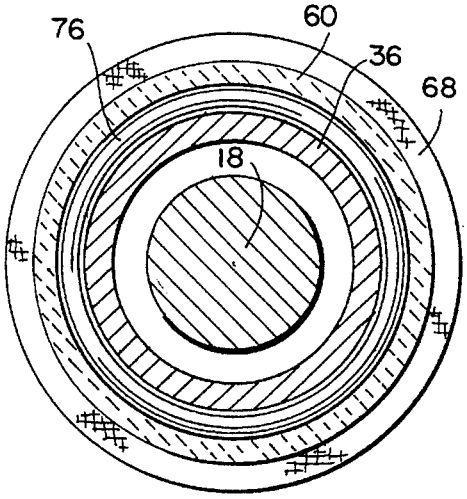
FIG. 5

APPARATUS FOR PREVENTING SPARKING IN A HIGH VOLTAGE ELECTRICAL PRECIPITATOR

BACKGROUND OF THE INVENTION

The invention relates to electrical precipitators, and more particularly to a method and apparatus to insulate and prevent sparking of the high voltage supply electrodes in an electrical precipitator.

Generally, electrical precipitators are used to remove pollutants from the exhaust created by burning fossil fuel. Specifically, in some energy generating power plants, electrical precipitators are used to remove fly ash produced by burning coal as a power source from the exhaust, or flue gases. With increasing regulations on the discharge of by-products such as fly ash into the atmosphere, it is desirable to increase the efficiency of existing precipitators, and produce new precipitators with higher performance levels.

Typically, an electrical precipitator has an array of discharge electrodes which are vertically suspended from a hanger frame in what is known as a precipitator box. The hanger frame is connected to a high voltage supply electrode extending vertically out of the precipitator box and through a precipitator roof which is at electrical ground. The supply electrode is electrically charged by a precipitator transformer and controlled by an automatic voltage controller. Typically, rapper rods are positioned inside the supply electrodes and are activated by a set of rappers, which may comprise an activation solenoid. An array of ground plates are also situated in the precipitator box parallel to the discharge electrodes and have separate rappers and rapper rods. The rapper rod and supply electrode combination extend through a support housing attached to the precipitator roof. Other rapper rods may be provided without supply electrodes and extend through nonsupport housings to the hanger frame.

In operation, the exhaust or flue gases produced by the coal burner are passed at right angles through the field of discharge electrodes and ground plates. As the fly ash in the exhaust moves through the field, the particles become electrically charged and are attracted to the ground plates and discharge electrodes. Periodically, as the ground plates and discharge electrodes become covered with fly ash, the rapper rods are activated by the rappers in the absence of an electric charge and physically jar the hanger frames to dislodge the fly ash and cause the particles to fall to the bottom of the precipitator box where they are later removed.

To increase the efficiency of the electrical precipitators, manufacturers have increased the supply voltage of the electric charge to levels where 70,000–75,000 volts have become common. The increased voltage to the discharge electrodes is designed to charge more of the fly ash particles in the precipitator box and therefore remove more fly ash from the flue gases. However, certain high voltage precipitators have not been performing as well as expected because the supply electrodes are sparking to the grounded precipitator roof and dissipating the higher voltage levels. Sparking prevents the discharge electrodes from reaching the high voltage potential supplied to the supply electrodes. As a result, the automatic voltage controller attempts to raise the voltage higher causing more frequent sparking from the supply electrodes to the precipitator roof and results in even lower voltage to the discharge electrodes in the precipitator box. Although the supply voltage is higher, the end result in overall precipitator performance is increasingly deteriorated. Further, even though some of the rapper rods do not have supply electrodes, they are connected to the hanger frame and do become electrically charged. Therefore, these rapper rods are subject to sparking and add to the above described problem.

SUMMARY OF THE INVENTION

The present invention provides a method and apparatus for improving precipitator performance by insulating the supply electrodes and rapper rods to prevent sparking and thereby provide increased supply voltage in the precipitator box. The apparatus comprises an alumina insulating sleeve surrounding and insulating the supply electrode or rapper rod in the area where the supply electrode and rapper rod pass through the precipitator roof. A shock absorber protects the insulating sleeve during rapping to provide extended life of the insulating sleeve.

The method for improving the performance of a rapper-type high voltage electrical precipitator having a supply electrode and a rapper rod passing through a grounded precipitator roof and attached at one end to a hanger frame, comprises the steps of installing an insulator to the supply electrode to insulate the supply electrode from the grounded precipitator roof, and protecting the insulator from the jarring effects of the rapper by installing a shock absorber between the hanger frame and the insulator. The method also includes installing the insulator to the rapper rods which extend through the nonsupport housings.

BRIEF DESCRIPTION OF THE DRAWINGS

FIG. 3 is a view similar to FIG. 2 but modified according to the present invention.

FIG. 4 is an enlarged partial sectional view of a portion of the structure of FIG. 3.

FIG. 5 is a cross-sectional view taken along line 5—5 of FIG. 3.

DETAILED DESCRIPTION OF THE PREFERRED EMBODIMENT

Figure 1:
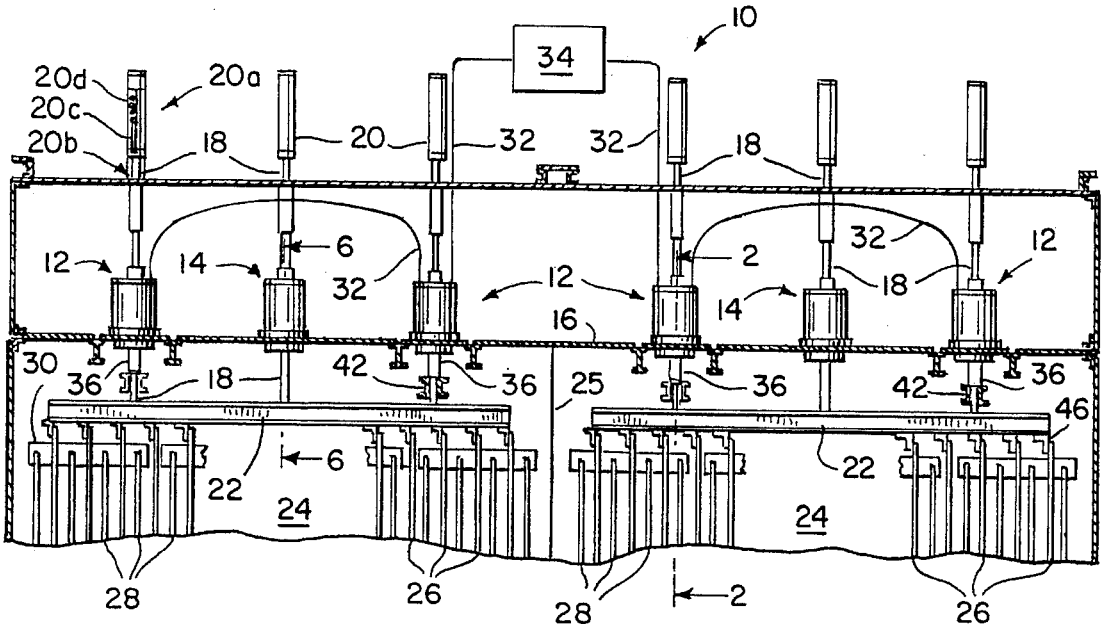
FIG. 1 PRIOR ART
FIG. 1 is a partial side plan view of an electrical precipitator known in the prior art.

FIG. 1 shows a partial view of a high voltage rapper-type electrical precipitator 10 having support housings 12 and non-support housings 14 attached to precipitator roof 16. Rapper rods 18 extend from rapper solenoids 20 to hanger frames 22 in precipitator box 24. With reference to exemplary rapper solenoid 20*a*, each of the rapper solenoids are rigidly supported by rapper supports 20*b* and have internal solenoid hammers 20*c* and solenoid springs 20*d*. Rapper rods 18 pass through support housings 12 and non-support housings 14. Hanger frame 22 has an array of discharge electrodes 26 attached to and hanging perpendicular to hanger frame 22 in precipitator box 24. An array of ground plates 28 hang parallel to discharge rods 26 from grounded hanger frame 30. Grounded hanger frame 30 is supported by a separate set of support housings (not shown) having a separate set of rapper rods (not shown). Each precipitator box 24 is separated by a partition frame 25.

Support housings 12 have electrical supply cables 32 connected to a transformer/rectifier 34. Support housings 12 have supply electrodes 36 to conduct electrical power from transformer/rectifier 34 through supply cables 32 and supply electrodes 36 to hanger frame 22 and discharge electrodes 26.

Figure 2:
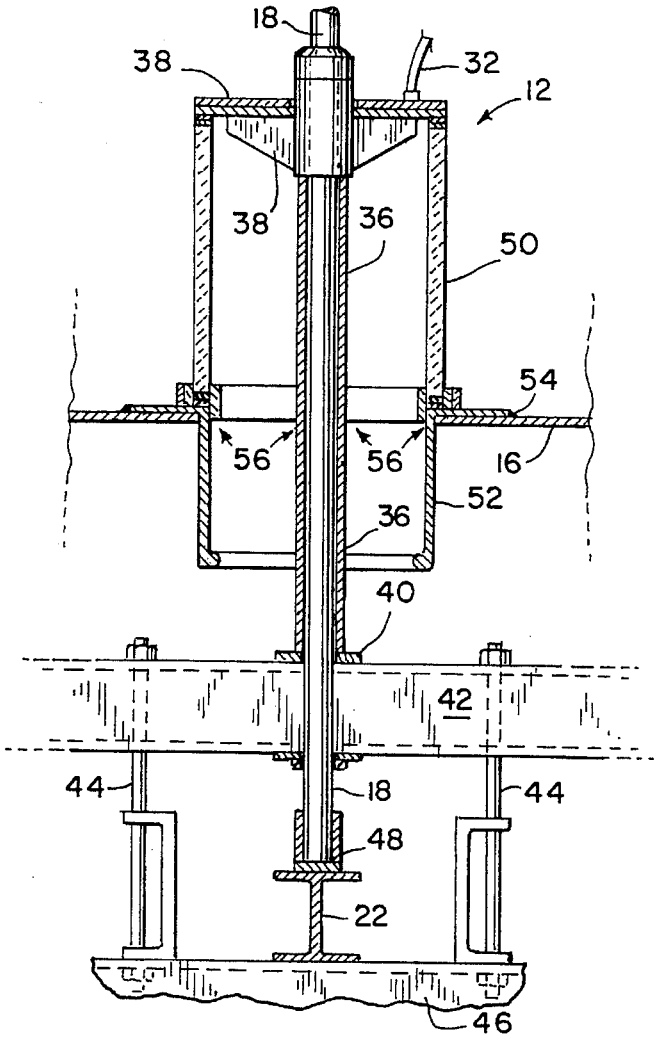
FIG. 2 PRIOR ART
FIG. 2 is a sectional view taken along line 2—2 of FIG. 1.

FIG. 2 shows a detailed sectional view of a support housing 12. Supply cable 32 is electrically connected to cover plate 38 which is in contact with supply electrode 36. Supply electrode 36 is welded to mounting bracket 40 which is welded to support beam 42. Support rods 44 suspend hanger frame 22 from support beam 42. Discharge electrode mounting bracket 46 is welded to the lower side of hanger frame 22 and has discharge electrodes 26, FIG. 1, hanging therefrom. Rapper rod 18, FIG. 2, extends through support housing 12 to rapper rod socket 48 which is welded to hanger frame 22.

Support housing 12 has support insulator 50 resting on support insulator mounting plate 52 which is welded at intermittent contact points 54 to precipitator roof 16. Support insulator mounting plate 52 is at the same electrical potential as precipitator roof 16 which is at ground potential. It has been found that when transformer/rectifier 34 supplies a high voltage charge to supply electrodes 36, occasionally supply electrodes 36 spark to support insulator mounting plate 52 in the general area designated by reference numeral 56 thereby depleting power to discharge electrodes 26, FIG. 1. The automatic voltage controller then senses an erroneously high current caused by the spark and increases the voltage thereby causing more frequent sparking.

FIG. 3 is a view similar to FIG. 2 but modified according to the present invention to prevent sparking. A cylindrical-shaped insulating sleeve 60 is positioned over supply electrode 36 to prevent sparking of the supply electrode to support insulator mounting plate 52 and precipitator roof 16. Insulating sleeve 60 has a diameter just larger than supply electrode 36 and has an approximate length extending from support beam 42 to cover plate 38. Insulating sleeve 60 is preferably composed of a ceramic known as alumina and has a wall thickness 62, FIG. 4, of approximately ¾ of an inch. The preferred embodiment uses an 82429 alumina tube from Coors Ceramic Company as the insulating sleeve.

A shock absorber 64, FIG. 3, is provided to protect insulating sleeve 60 from the vibrational shock associated with rapping rapper rod 18 on hanger frame 22. Shock absorber 64 is comprised of a compression ring 66, FIG. 4, and a section of compression blanket 68. Compression ring 66 has an inside diameter 70 slightly larger than supply electrode 36 to allow compression ring 66 to slide over and down supply electrode 36, and an outside diameter 72 larger than inside diameter 74 of insulating sleeve 60 to support and protect the insulating sleeve. Compression ring 66 is preferably cut from a McMaster-Carr 8545K47 Teflon® sheet. Preferably, compression blanket 68 is cut from high temperature Isotherm 750 safety blanket produced by Frenzelit NorthAmerica, Inc. High temperature packing rope 76 is wound between supply electrode 36 and insulating sleeve 60 to limit lateral movement of insulating sleeve 60 while permitting some yielding to accommodate for shock absorption. A high temperature RTV sealant 78 seals off the top of insulating sleeve 60.

FIG. 5 shows a cross-sectional top view of rapper rod 18, supply electrode 36, high temperature rope packing 76 and insulating sleeve 60, and compression blanket 68.

Figure 6:
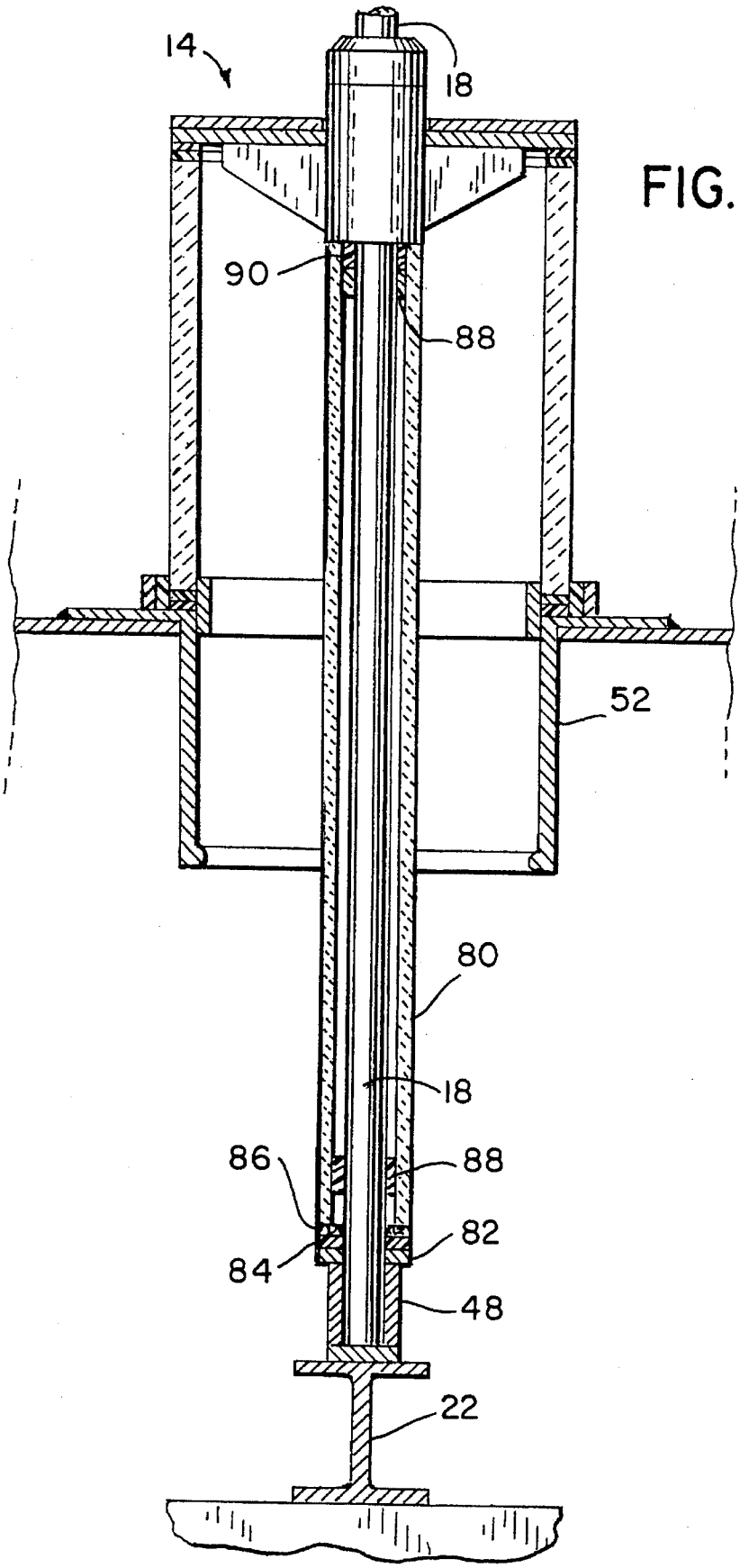
FIG. 6 is a sectional view taken along line 6—6 of FIG. 1 but modified according to the present invention.

FIG. 6 shows a detailed sectional view of a nonsupport housing 14 having a rapper rod 18 without a supply electrode 36, FIG. 1. Rapper rod 18 extends from rapper solenoid 20 to hanger frame 22 having rapper rod socket 48, FIG. 6. Since hanger frame 22 and rapper rod 18 are electrically conductive, the voltage supplied to supply electrode 36 may produce sparking in nonsupport housing 14 similar to that produced in support housing 12, FIG. 3.

To prevent sparking from rapper rod 18, FIG. 6, to support insulator mounting plate 52, an insulating sleeve 80 is placed over rapper rod 18. An insulating sleeve support 82 is welded to rapper rod socket 48 to support compression ring 84, compression blanket 86 and insulating sleeve 80 as previously described. High temperature packing rope 88 is wound around rapper rod 18 at the top and bottom to prevent lateral movement and high temperature RTV sealant 90 seals the top of insulating sleeve 80, all as previously described. Since rapper rod 18 has a smaller outside diameter than supply electrode 36, insulating sleeve 80, compression ring 84, and compression blanket 86 have proportionally smaller diameters than those for insulating supply electrode 36. A Coors Ceramic Company 82424 alumina tube is used as the insulating sleeve 80, FIG. 6, over rapper rod 18.

The present invention is readily adaptable to existing high voltage rapper-type electrical precipitators having a supply electrode passing through a precipitator roof which is at electrical ground. Since the steps to insulate a supply electrode are similar to the steps to insulate a rapper rod, reference is made to FIG. 3 for basic description. The method to improve the performance of such a high voltage rapper-type electrical precipitator for preventing sparking to precipitator roof 16 or support insulator mounting plate 52, comprises removing cover plate 38, installing shock absorber 64 which comprises installing compression ring 66, FIG. 4, and placing compression blanket 68 on top of compression ring 66, and thereafter sliding insulating sleeve 60 over supply electrode 36. Prior to insulating sleeve 60 seating on compression blanket 68, high temperature packing rope 76 is wound around supply electrode 36. Insulating sleeve 60 is pressed downward over the high temperature packing rope 76 and onto compression blanket 68. A second section of high temperature packing rope 76 is wound around the top of supply electrode 36 and pressed down between supply electrode 36 and insulating sleeve 60. The top of insulating sleeve 60 is sealed with high temperature RTV sealant 78 and cover plate 38 is reinstalled.

Although shock absorber 64 has been defined in terms of a compression ring and a compression blanket, it is readily apparent that other suitable high temperature materials may be substituted to provide shock absorption and protection to insulating sleeve 60. Further, the insulating sleeve in the preferred embodiment is composed of alumina, but may be replaced with a thicker piece of ordinary ceramic, or any other high voltage insulating material. These and other equivalents, alternatives and modifications are possible and within the scope of the appended claims.

I claim:

1. In a high voltage rapper electrical precipitator having an electrical conductor passing through a precipitator roof, an insulator comprising:

an insulating sleeve having a diameter larger than the electrical conductor and mounted over the electrical conductor and extending downwardly past the precipitator roof and preventing arcing between the electrical conductor and the precipitator roof; and a shock absorber mounted under the insulating sleeve.

2. The insulator of claim 1 wherein the electrical conductor is a supply electrode.

3. The insulator of claim 1 wherein the electrical conductor is a rapper rod.

4. The insulator of claim 1 wherein the insulating sleeve is cylindrical-shaped and composed of ceramic.

5. The insulator of claim 4 wherein the ceramic comprises alumina.

6. The insulator of claim 4 wherein the insulating sleeve has a wall thickness of approximately ¾ of an inch.

7. The insulator of claim 1 wherein the shock absorber comprises a compression ring having an inside diameter larger than the electrical conductor and an outside diameter larger than an inside diameter of the insulating sleeve.

8. The insulator of claim 1 further comprising a high temperature packing rope between the electrical conductor and the insulating sleeve.

9. A high voltage rapper electrical precipitator comprising a precipitator roof, an outer insulator supported on the roof, an electrical conductor passing through the roof and within the outer insulator, an insulating sleeve spaced from and positioned within the outer insulator and having a diameter larger than the electrical conductor and mounted over the electrical conductor, a shock absorber mounted under the insulating sleeve and comprising a compression ring having an inside diameter larger than the electrical conductor and an outside diameter larger than an inside diameter of the insulating sleeve, and a compression blanket between the compression ring and the insulating sleeve.

10. An electrical precipitator apparatus comprising:

a precipitator having a high voltage supply electrode passing through a support insulator and a precipitator roof, and a rapper rod passing through a nonsupport insulator and the precipitator roof;

a first insulating sleeve placed over the high voltage supply electrode and extending upwardly past the precipitator roof and extending downwardly past the precipitator roof and preventing arcing between the high voltage supply electrode and the precipitator roof;

a second insulating sleeve placed over the rapper rod and extending upwardly past the precipitator roof and extending downwardly past the precipitator roof and preventing arcing between the rapper rod and the precipitator roof;

a first shock absorber under the first insulating sleeve; and a second shock absorber under the second insulating sleeve.

11. The precipitator of claim 10 wherein the first and second insulating sleeves are cylindrical-shaped and composed of ceramic.

12. The precipitator of claim 10 wherein the first and second insulating sleeves are composed of alumina.

13. The precipitator of claim 10 wherein the first and second insulating sleeves have a wall thickness of approximately ¾ of an inch.

14. The precipitator of claim 10 wherein the first shock absorber comprises a compression ring having an inside diameter larger than the supply electrode and an outside diameter larger than the first insulating sleeve and wherein the second shock absorber comprises a compression ring having an inside diameter larger than the rapper rod and an outside diameter larger than the second insulating sleeve.

15. The precipitator of claim 10 further comprising high temperature packing rope between the high voltage supply electrode and the first insulating sleeve and between the rapper rod and the second insulating sleeve.

16. An electrical precipitator apparatus comprising:

a precipitator having a high voltage supply electrode passing through a support insulator and a precipitator roof, and a rapper rod passing through a nonsupport insulator and the precipitator roof;

a first insulating sleeve placed over the high voltage supply electrode and extending upwardly past the precipitator roof and spaced from and positioned within the support insulator;

a second insulating sleeve placed over the rapper rod and extending upwardly past the precipitator roof and spaced from and positioned within the nonsupport insulator;

a first shock absorber under the first insulating sleeve and comprising a first compression ring having an inside diameter larger than the supply electrode and an outside diameter larger than the first insulating sleeve, and a first compression blanket between the first compression ring and the first insulating sleeve;

a second shock absorber under the second insulating sleeve, and comprising a second compression ring having an inside diameter larger than the rapper rod and an outside diameter larger than the second insulating sleeve, and a second compression blanket between the second compression ring and the second insulating sleeve.

17. A high voltage electrical precipitator comprising:

a precipitator roof;

an outer insulator supported on said roof;

support structure within said precipitator and suspending a plurality of discharge electrodes therefrom;

an electrical conductor extending downwardly within said outer insulator through said roof to said support structure;

an insulating sleeve around said electrical conductor and spaced from and positioned within said outer insulator;

a shock absorber between said insulating sleeve and said support structure and supporting said insulating sleeve on said support structure such that said shock absorber rests on said support structure, and said insulating sleeve rests on said shock absorber.

18. A high voltage electrical precipitator comprising:

a precipitator roof;

an outer insulator supported on said roof;

a hanger frame within said precipitator and having a plurality of discharge electrodes hanging therefrom;

a support beam suspending said hanger frame;

a supply electrode within and supported by said outer insulator and extending downwardly through said roof and supporting said support beam;

a rapper rod extending downwardly through said supply electrode and through said support beam to said hanger frame;

an insulating sleeve around said supply electrode and spaced from and positioned within said outer insulator;

a shock absorber between said insulating sleeve and said support beam and supporting said insulating sleeve on said support beam such that said shock absorber rests on said support beam, and said insulating sleeve rests on said shock absorber.

19. A high voltage electrical precipitator comprising:

a precipitator roof;

an outer insulator supported on said roof;

a hanger frame within said precipitator and having a plurality of discharge electrodes hanging therefrom;

a rapper rod within said outer insulator and extending downwardly through said roof to said hanger frame;

an insulating sleeve around said rapper rod and spaced from and positioned within said outer insulator;

a shock absorber between said insulating sleeve and said hanger frame and supporting said insulating sleeve on said hanger frame such that said shock absorber rests on said hanger frame, and said insulating sleeve rests on said shock absorber.

* * * * *